United States Patent [19]

Carter et al.

[11] 4,204,811

[45] May 27, 1980

[54] FLUID PUMPING SYSTEM

[75] Inventors: William L. Carter, Scottsdale; Jack F. Greathouse; Philip T. Zeilinger, both of Tempe, all of Ariz.

[73] Assignee: The Garrett Corporation, Los Angeles, Calif.

[21] Appl. No.: 826,090

[22] Filed: Aug. 19, 1977

[51] Int. Cl.[2] ..... F04B 47/08

[52] U.S. Cl. ..... 417/288; 417/428; 417/304; 418/196

[58] Field of Search ..... 417/2, 3, 62, 286, 288, 417/310, 428, 302, 304; 418/9, 10, 196, 15; 60/420, 422, 428, 430, 421, 486

[56] References Cited

U.S. PATENT DOCUMENTS

| | | | |
|---|---|---|---|
| 2,103,530 | 12/1937 | Henry | 60/421 |
| 2,669,842 | 2/1954 | Slomer | 60/430 |
| 2,933,158 | 4/1960 | Pitts | 417/310 |
| 3,385,312 | 5/1968 | Kinnamon et al. | 417/287 |
| 3,535,877 | 10/1970 | Becker et al. | 60/422 |

FOREIGN PATENT DOCUMENTS

| | | | |
|---|---|---|---|
| 588457 | 12/1959 | Canada | 417/286 |

*Primary Examiner*—Richard E. Gluck
*Attorney, Agent, or Firm*—Albert J. Miller; Joel D. Talcott; Stuart O. Lowry

[57] ABSTRACT

A fluid pumping system comprises a fluid pump having multiple fluid outlet flows coupled to relatively low and high pressure loads. A control valve system controls the pressure levels of the low and high pressure flows, and relieves excess fluid from the high pressure flow to the low pressure flow to augment the low pressure flow.

19 Claims, 1 Drawing Figure

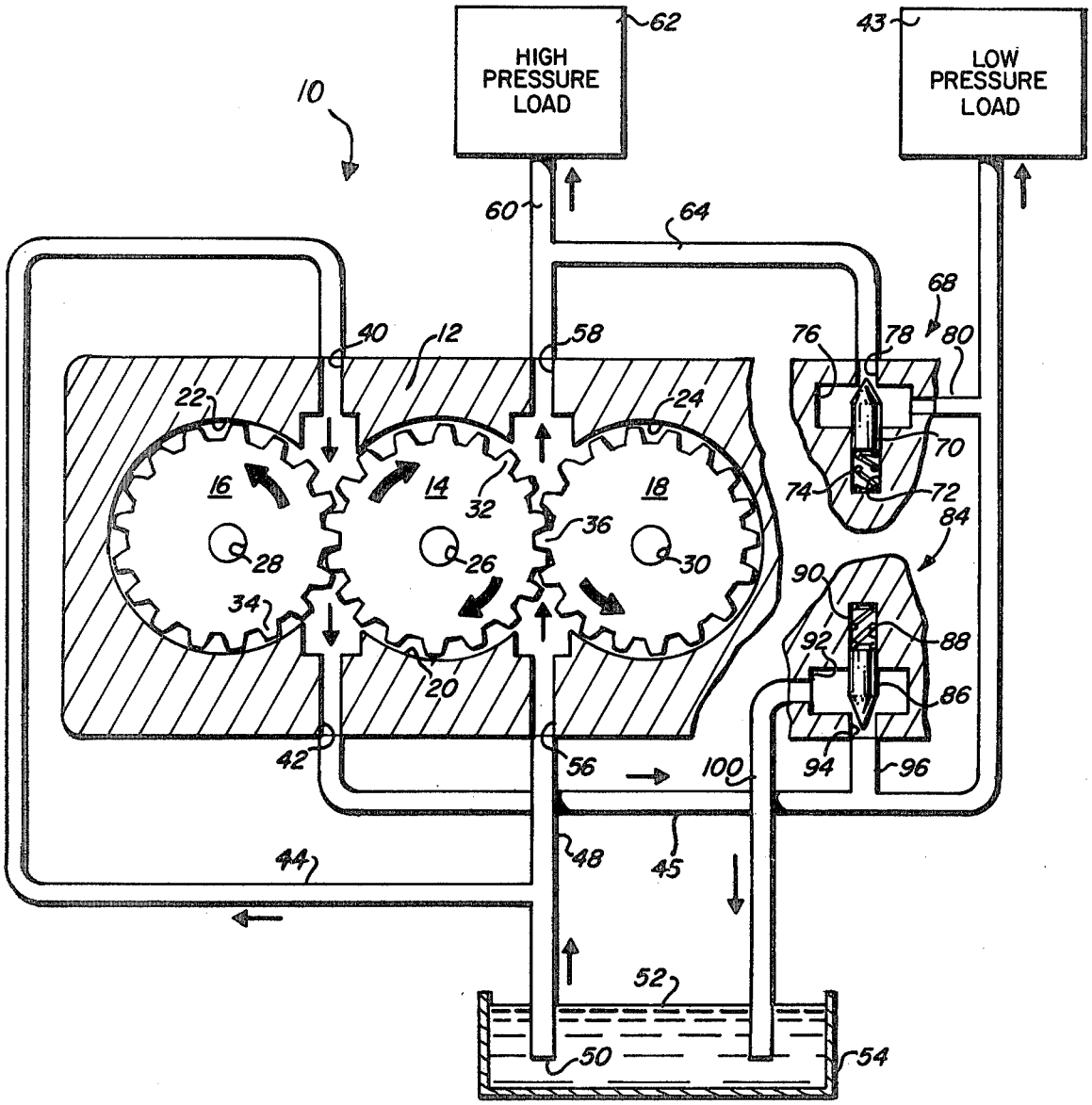
HIGH PRESSURE LOAD
LOW PRESSURE LOAD
10
62
43
60
64
68
40
12
58
76
78
80
22
24
70
16
14
18
32
74
72
36
84
28
26
30
90
34
92
88
20
86
42
56
100
94
96
44
48
45
52
50
54

FLUID PUMPING SYSTEM

BACKGROUND OF THE INVENTION

This invention relates to a fluid pumping system. More specifically, this invention relates to a fluid pumping system for pumping a fluid such as an hydraulic liquid, and having separate fluid outlet flows at different pressure levels.

Fluid pumping devices such as gear pump assemblies are readily available in the prior art. Such gear pumps typically comprise at least two meshing rotatable gears carried in a relatively close-fitting pump housing, with one of the gears being rotatably driven by a suitable motor. The housing includes a fluid inlet and a fluid outlet located on opposite sides of the gears generally along a common tangent between the meshing gears. As the gears rotate, a fluid is drawn into the fluid inlet, and is carried through the housing by the gears for discharge via the fluid outlet. From the outlet, the fluid is pumped further through conduits or the like to a desired location such as, for example, shaft bearings, control devices, etc. Of course, the pneumatic or hydraulic pressure of the fluid pumped through the conduits is related to the mass flow rate of the fluid and/or the particular load encountered.

Gear pumps are particularly useful in a wide variety of applications for supplying fluid such as lubricating oil to moving parts in many types of rotating machines. For example, in a typical gas turbine engine, a relatively high quantity of lubricant pumped at a relatively low pressure is required for the lubrication and cooling of bearings, transmission components, and the like. For such applications, gear pumps are convenient in that they are readily coupled to the rotating machine for rotation of the pumping gears along with the machine. However, with many machines such as a gas turbine engine, different quantities and pressure levels of fluid are required at different locations at varying intervals. For example, bearings and the like typically require relatively low pressure, high volumetric supplies of fluid whereas relatively high pressure low volumetric supplies of fluid may be intermittently required for operating control devices such as hydraulic controls and the like.

In the prior art, dual pressure fluid supplies have been obtained primarily through the use of separate gear pumps designed for supplying different fluid flow rates at different pressure levels. Alternately, prior art gear pumps have been provided including multiple pump stages, with output conduits being connected between pump stages for obtaining different output pressure levels. See, for example U.S. Pat. Nos. 2,256,743; 2,309,443; 2,699,726; 2,917,898; and 3,435,773 relating to the construction and operation of representative prior art gear pumps. All of these pumps are disadvantageous, however, in that they do not provide a minimum of pumping gears and pump control devices, and thereby do not minimize the cost and compactness of the pumping system. Moreover, these prior art pumping systems require relatively large amounts of machine power in order to provide a relatively high pressure fluid outlet flow.

This invention overcomes the problems and disadvantages of the prior art by providing a relatively compact and integrated fluid pumping system having a plurality of pumping gears and controlling valves cooperating to provide a plurality of fluid outlet flows at different flow rates and pressure levels, and requiring a minimum of power for operation.

SUMMARY OF THE INVENTION

In accordance with the invention, a fluid pumping system comprises a gear pump having at least three generally identical pumping gears rotatably carried in a gear pump housing. The center one of the three gears meshes with the remaining two gears, and one of said gears is rotatably driven by suitable motor means whereby the gears comprise, in effect, two pairs of simultaneously rotatable pumping gears. The housing includes a pair of fluid inlets and a pair of fluid outlets with one fluid inlet and one fluid outlet communicating with each pair of pumping gears on opposite sides of the gears generally along a line tangent to the associated meshing gears.

Upon rotation, the pumping gears draw a fluid from a fluid supply into the pump housing through the fluid inlets, and then discharge the fluid through the fluid outlets. One outlet is coupled to a relatively high pressure load, and the other outlet is coupled to a relatively low pressure load. A first control valve coupled between the high and low pressure outlets is operable to relieve excess flow from the high pressure outlet into the low pressure fluid flow, and thereby supplement the low pressure flow rate. A second control valve coupled between the low pressure outlet and the fluid supply serves to relieve excess flow from the low pressure outlet, and thereby maintain a desired pressure level in the low pressure outlet.

BRIEF DESCRIPTION OF THE DRAWING

The accompanying drawing illustrates the invention, and comprises a schematic diagram of a fluid pumping system of this invention.

DETAILED DESCRIPTION OF THE PREFERRED EMBODIMENT

A fluid pumping system 10 of this invention is shown in the drawing, and comprises a pump housing 12 with three pumping gears 14, 16 and 18 mounted therein. More specifically, the housing 12 includes three generally cylindrical pumping gear chambers 20, 22, and 24 formed side-by-side, with the center one 20 of the three chambers slightly overlapping the remaining two chambers 22 and 24 so that the three chambers are generally open to each other. The three pumping gears 14, 16, and 18 are respectively disposed within the three chambers 20, 22, and 24, and are carried on rotatable shafts 26, 28, and 30 centered within said chambers. Importantly, the shaft 26 within the center one 20 of the three chambers is rotatably driven by a suitable motor or other power source (not shown).

The three pumping gears 14, 16, 18 are generally identical to each other, and include circumferential sets of meshing gear teeth 32, 34, and 36, respectively. That is, as shown in the drawing, the gear 14 includes a set of gear teeth 32 which mesh with the set of teeth 34 on the gear 16 as well as the set of teeth 36 on the gear 18. Thus, as the center pumping gear 14 is rotated in a clockwise direction as shown in the drawing, the pumping gears 16 and 18 are correspondingly rotated in a counterclockwise direction. Accordingly, the two pumping gears 14 and 16 form one gear pump with the teeth 32 and 34 meshing together, and the gears 14 and 18 form a second gear pump with the teeth 32 and 36 meshing together.

The pump housing 12 includes a fluid inlet 40 and a fluid outlet 42 disposed generally on a common tangent between the gears 14 and 16, and on opposite sides of said gears. A fluid conduit 44 has one end coupled to the fluid inlet 40, and its other end coupled to a supply conduit 48. In turn, the supply conduit 48 has an open end 50 received in a supply of fluid 52, such a lubricating oil, carried in a fluid supply reservoir 54. The fluid outlet 42 of the pumping gears 14 and 16 is coupled to a relatively low pressure load 43 such as bearings, transmission components, etc., via an outlet conduit 45.

In a similar manner, an additional fluid inlet 56 and an additional fluid outlet 58 are formed in the pump housing 12 generally on a common tangent between the two pumping gears 14 and 18, and on opposite sides of said gears. The fluid inlet 56 is coupled to the supply conduit 48 downstream of the conduit 44. The fluid outlet 58 for the gears 14 and 18 is coupled to an additional outlet conduit 60 which in turn supplies fluid to a relatively higher pressure, lower volume load 62, such as control devices and the like.

In operation, the pumping gears 14, 16 and 18 are simultaneously rotated to draw the fluid 52 from the reservoir 54 through the inlet conduits 44 and 48. The teeth 32 and 34 on the gears 14 and 16 carry the incoming fluid 52 in the direction of the gear rotation between the gears and the walls of the gear chambers 20 and 22. More specifically, the gear 14 carries the incoming fluid toward the outlet 58 of the gears 14 and 18, and the gear 16 carries the fluid toward the outlet 42. Similarly, the teeth 32 and 36 on the gears 14 and 18 carry the incoming fluid in the direction of their rotation between the gears and the walls of the chambers 20 and 24 to carry the fluid toward the outlets 42 and 58, respectively. Importantly, the volumetric flow through each outlet 44 and 58 is substantially the same, and the gears 14, 16 and 18 are shaped with respect to each other and the chambers 20, 22, and 24 so that fluid flow around the ends of the gears or between the meshing gear teeth is substantially prevented.

In machinery applications, such as in a gas turbine engine, the pressure and flow rate requirements of the low and high pressure loads 43 and 62 are substantially different. Typically, for example, the low pressure load 43 comprises bearing and/or transmission components requiring a relatively high fluid flow rate and low pressure, and the high pressure load 62 comprises control devices or the like requiring relatively low fluid flow rate and high pressure. To meet these requirements, a relief conduit 64 is coupled between the high pressure outlet conduit 60 and a relief or control valve 68 conveniently mounted on the housing 12. The control valve 68 comprises a valve stem 70 carried in a guide passage 72 formed within the housing 12. A compression spring 74 is seated in the bottom of the passage 72, and serves to bias the stem 70 to project across a chamber 76 and engage a valve seat 78 to thereby close the conduit 64 against flow of high pressure fluid. The spring 74 is selected to deflect when a predetermined high pressure level is reached, whereby the valve stem 70 moves against the spring 74 to allow excess high pressure fluid to flow through the conduit 64 and the chamber 76, and further through a conduit 80 to the low pressure outlet conduit 45. In this manner, the relatively high pressure in the outlet conduit 60 is maintained to supply the load 62 with the desired high pressure fluid. However, the valve 68 prevents the high pressure flow from exceeding a predetermined pressure level regardless of relatively low flow rate requirements of the high pressure load 62 by relieving the high pressure flow into the low pressure conduit 45.

A second relief or control valve 84 is mounted on the housing 12 for controlling the pressure level in the low pressure outlet conduit 45. Specifically, the valve 84 comprises a valve stem 86 carried in a suitably formed guide passage 88, and biased by a compression spring 90 within the guide passage 88 to project across a chamber 92 and engage a valve seat 94. The valve 84 serves to control the passage of low pressure fluid through a conduit 96 coupled to the low pressure outlet conduit 45. With this construction, whenever fluid pressure in the low pressure outlet conduit 45 exceeds a predetermined level governed by the selection of the spring 90, the valve stem 86 moves to open the valve 84 and allow the fluid to flow through the chamber 92 of the valve 84, and further through a drain conduit 100 to the fluid supply reservoir 54. Alternately, if desired, the drain conduit may be substituted by a port or the like whereby the fluid is gravitationally returned to the reservoir.

In the operation of the pumping system of this invention, the pumping gears 14, 16, and 18 are simultaneously driven and sized to provide substantially equal flow rates through the outlet conduits 42 and 58, with the conduit pressure being governed by the characteristics of the particular load and the settings of the valves 68 and 84. However, in a typical situation, the high pressure load 62 requires a relatively low volume, high pressure intermittent fluid flow. Accordingly, the excess fluid flow in the high pressure conduit 60 normally bypasses to the low pressure conduit 45 via the control valve 68. In this manner, the control valve 68 functions to allow the excess of fluid flow from the conduit 60 to supplement the low pressure flow, and thereby increase the flow rate in the low pressure conduit 45 above the pumping capacity of the pumping gears 14 and 16. By way of example, if the pumping gears 14, 16, and 18 are sized and driven to pump ten gallons of lubricant per minute through each outlet conduit 45 and 58, and the high pressure load requires an average of two gallons per minute, then eight gallons per minute of high pressure lubricant will be relieved into the low pressure flow to supplement that flow. Thus, depending upon the setting of the valve 84, the flow rate in the low pressure conduit 45 may total up to eighteen gallons per minute in spite of the substantially lower pumping capacity of the gears 14 and 16. Therefore, with this construction, the pumping gears 14, 16, and 18 are undersized for purposes of directly supplying the low pressure conduit 45, with the supply deficit being overcome by the relieved portion of the high pressure supply. This results in a pumping system which adequately supplies both loads 43 and 62 with pressure and fluid, and which requires a minimum power consumption for operation.

The pumping system of this invention is particularly useful in applications such as gas turbine engines wherein the flow rate demand of the high pressure load is relatively small and intermittent. In this situation, under normal operation, the high and low pressure flows are summed in the low pressure outlet conduit to substantially supplement the low pressure flow rate. When the high pressure load calls for fluid flow, the low pressure flow rate momentarily drops until high pressure demand ceases. However, in most applications, this momentary drop in the low pressure fluid flow rate or pressure is not detrimental to the continued operation of the low pressure load components.

Various modifications and improvements upon the fluid pumping system of this invention are believed to be possible without varying from the scope of the invention. For example, while various conduits are disclosed connected to the pump housing, it is contemplated that substantially all of the conduits may be cast integrally with the pump housing. Moreover, various relief valve structures responsive to pressure may be used. Still further, it may be desirable to vary the construction and/or operation and driving of the gear pump so long as the pump provides two or more fluid outlet flows for control by means of a plurality of relief valves.

What is claimed is:

1. A fluid pumping system comprising pumping means for pumping fluid from a fluid supply through a first outlet and a second outlet; a relatively high pressure fluid load coupled to said first outlet; a relatively low pressure fluid load coupled to said second outlet; conduit means for providing a flow path between said first outlet and second outlet; and valve means for controllably opening and closing said conduit means to fluid flow in response to the fluid pressure level in said first outlet to controllably relieve a portion of the fluid flow in said first outlet through said conduit means to supplement the fluid flow in said second outlet and prevent the pressure level in said first outlet from exceeding a predetermined level.

2. A fluid pumping system as set forth in claim 1 including second conduit means for providing a flow path between said second outlet and the fluid supply, and second valve means for controllably opening and closing said second conduit means to fluid flow in response to the fluid pressure level in said second outlet to controllably relieve a portion of the fluid flow in said second outlet through said second conduit means to the fluid supply to prevent the pressure level in said second outlet from exceeding a predetermined level.

3. A fluid pumping system as set forth in claim 2 wherein said pumping means comprises a gear pump.

4. A fluid pumping system as set forth in claim 3 wherein said gear pump comprises first, second, and third pumping gears carried in a pump housing with said first gear meshing with said second gear and with said third gear, said first and second gears communicating with said first outlet, and said first and third gears communicating with said second outlet.

5. A fluid pumping system as set forth in claim 4 wherein said first, second, and third pumping gears are substantially identical.

6. A fluid pumping system comprising pumping means for pumping fluid from a fluid supply through a first outlet and a second outlet; a relatively high pressure fluid load coupled to said first outlet; a relatively low pressure fluid load coupled to said second outlet; first means responsive to the pressure level of fluid in said first outlet for relieving a portion of the fluid flow in said first outlet to said second outlet to supplement fluid flow in said second outlet and to prevent the pressure level in said first outlet from exceeding a predetermined level; and second means responsive to the pressure level of fluid in said second outlet for relieving a portion of the fluid flow in said second outlet to the fluid supply to prevent the pressure level in said second outlet from exceeding a predetermined level.

7. A fluid pumping system as set forth in claim 6 wherein said first means comprises conduit means coupled between said first and second outlets, and pressure responsive valve means for controllably opening and closing said conduit means.

8. A fluid pumping system as set forth in claim 6 wherein said second means comprises conduit means coupled between said second outlet and said fluid supply, and pressure responsive valve means for controllably opening and closing said conduit means.

9. A fluid pumping system as set forth in claim 6 wherein said pumping means comprises a gear pump having first, second, and third substantially identical pumping gears carried in a pump housing with said first gear meshing with said second gear and with said third gear, said first and second gears communicating with said first outlet, and said first and third gears communicating with said second outlet.

10. A fluid pumping system for pumping fluid from a fluid supply comprising a gear pump having a first pumping gear meshing with a second pumping gear and with a third pumping gear, said first and second gears being for pumping fluid from the fluid supply through a first pump outlet, and said first and third pumping gears being for pumping fluid from said supply through a second pump outlet; a relatively high pressure fluid load coupled to said first pump outlet; a relatively low pressure fluid load coupled to said second pump outlet; first means coupled between said first and second outlets and responsive to the pressure level of fluid in said first outlet for controllably relieving a portion of the fluid flow in said first outlet to said second outlet to supplement the fluid flow in said second outlet and to prevent the pressure level in said first outlet from exceeding a predetermined level; and second means coupled between the second outlet and the fluid supply and responsive to the pressure level of fluid in said second outlet for controllably relieving a portion of the fluid flow in said second outlet to said fluid supply to prevent the pressure level in said second outlet from exceeding a predetermined level.

11. A fluid pumping system comprising pumping means for pumping fluid from a fluid supply through a plurality of pump outlets at substantially uniform flow rates, said pump outlets being coupled individually to respective ones of a plurality of fluid loads of differing pressure levels; and means responsive to pressure in at least one relatively higher pressure outlet for relieving a portion of the fluid flow in said at least one higher pressure outlet to at least one relatively lower pressure outlet to prevent the pressure level in said at least one higher pressure outlet from exceeding a predetermined pressure level and to supplement the fluid flow in said at least one lower pressure outlet.

12. A fluid pumping system for pumping fluid from a fluid supply comprising a gear pump having a plurality of pumping gears for pumping fluid from the supply through a first pump outlet and a second pump outlet; a relatively high pressure fluid load coupled to said first pump outlet; a relatively low pressure fluid load coupled to said second pump outlet; first means coupled between said first and second outlets and responsive to the pressure level of fluid in said first outlet for controllably relieving a portion of the fluid flow in said first outlet to said second outlet to supplement the fluid flow in said second outlet and to prevent the pressure level in said first outlet from exceeding a predetermined level; and second means coupled between the second outlet and the fluid supply and responsive to the pressure level of fluid in said second outlet for controllably relieving a portion of the fluid flow in said second outlet to said fluid supply to prevent the pressure level in said second outlet from exceeding a predetermined level.

13. A fluid pumping method comprising the steps of pumping fluid from a fluid supply through a first outlet and a second outlet; coupling said first outlet to a relatively high pressure fluid load, and said second outlet to a relatively low pressure fluid load; and controllably relieving a portion of the fluid flow in said first outlet to said second outlet in response to the pressure level of fluid flow in said first outlet to supplement the flow in said second outlet and to prevent the pressure level in said first outlet from exceeding a predetermined level.

14. The method of claim 13 including the step of controllably relieving a portion of the fluid flow in said second outlet to said fluid supply in response to the pressure level of fluid in said second outlet to prevent the pressure level in said second outlet from exceeding a predetermined level.

15. The method of claim 14 wherein said step of controllably relieving a portion of the fluid flow in said second outlet comprises the steps of providing a flow path between said second outlet and the fluid supply, and controllably opening and closing said flow path with pressure responsive valve means.

16. The method of claim 13 wherein said step of controllably relieving a portion of the fluid flow in said first outlet comprises the steps of providing a flow path between said first and second outlets, and controllably opening and closing said flow path with pressure responsive valve means.

17. The method of claim 13 wherein said pumping step comprises pumping fluid with a gear pump having first, second, and third pumping gears with said first pumping gear meshing with said second gear and with said third gear, said first and second gears pumping fluid through said first outlet, and said first and third gears pumping fluid through said second outlet.

18. A fluid pumping method comprising the steps of pumping fluid from a fluid supply through a plurality of pump outlets at substantially uniform flow rates; coupling said outlets individually to respective ones of a plurality of fluid loads of differing pressure levels; and controllably relieving a portion of the fluid flow in at least one higher pressure outlet to at least one lower pressure outlet in response to the pressure level of fluid in said at least one higher pressure outlet to prevent the pressure level in said at least one higher pressure outlet from exceeding a predetermined level and to supplement the fluid flow in said at least one lower pressure outlet.

19. A fluid pumping method comprising the steps of pumping fluid from a fluid supply through first and second pump outlets; connecting said first outlet to a relatively high pressure fluid load; connecting said second outlet to a relatively low pressure fluid load; controllably relieving a portion of the fluid flow in said first outlet to said second outlet in response to the pressure level of fluid in said first outlet to supplement the fluid flow in said second outlet and to prevent the pressure level in said first outlet from exceeding a predetermined level; and controllably relieving a portion of the fluid flow in said second outlet to said fluid supply in response to the pressure level of fluid in said second outlet to prevent the pressure level in said second outlet from exceeding a predetermined level.

* * * * *

Disclaimer 4,204,811.—*William L. Carter*, Scottsdale; *Jack F. Greathouse* and *Philip T. Zelinger*, Tempe, Ariz. FLUID PUMPING SYSTEM. Patent dated May 27, 1980. Disclaimer filed Sept. 18, 1980, by the assignee, *The Garrett Corporation.*

Hereby enters this disclaimer to claims 1–19 all claims of said patent.

[*Official Gazette November 18, 1980.*]